US006311410B1

(12) United States Patent
Heikkila et al.

(10) Patent No.: US 6,311,410 B1
(45) Date of Patent: Nov. 6, 2001

(54) METHOD AND DEVICE FOR DRYING A COATED WEB

(75) Inventors: Pertti Heikkila, Raisio; Kari Juppi, Palokka; Pasi Rajala, Järvenpää, all of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/743,091

(22) PCT Filed: Jun. 21, 1999

(86) PCT No.: PCT/FI99/00542

§ 371 Date: Jan. 5, 2001

§ 102(e) Date: Jan. 5, 2001

(87) PCT Pub. No.: WO00/01881

PCT Pub. Date: Jan. 13, 2000

(30) Foreign Application Priority Data

Jul. 6, 1998 (FI) ..... 981548

(51) Int. Cl.[7] ..... F26B 3/00

(52) U.S. Cl. ..... 34/444; 34/445; 34/446; 34/557

(58) Field of Search ..... 34/443, 444, 445, 34/446, 491, 557, 122, 629, 114, 119, 130

(56) References Cited

U.S. PATENT DOCUMENTS

| | | | | |
|---|---|---|---|---|
| 4,139,953 | * | 2/1979 | Gaskell | 34/445 |
| 4,872,270 | * | 10/1989 | Fronheiser et al. | 34/446 |
| 4,914,835 | * | 4/1990 | Kose et al. | 34/446 |
| 4,916,829 | * | 4/1990 | Takiue et al. | 34/446 |
| 5,421,097 | * | 6/1995 | Yamamoto et al. | 34/446 |
| 5,536,535 | | 7/1996 | Yamazaki et al. . | |
| 5,619,807 | * | 4/1997 | Conrad | 34/446 |
| 5,625,962 | * | 5/1997 | Fleissner | 34/446 |
| 5,632,201 | * | 5/1997 | Roch | 34/446 |
| 5,651,863 | * | 7/1997 | Van Haag et al. | 34/114 |
| 6,001,421 | * | 12/1999 | Ahonen et al. | 34/446 |

FOREIGN PATENT DOCUMENTS

| | | |
|---|---|---|
| 32 09 475 A1 | 9/1983 | (DE) . |
| 37 41 128 A1 | 6/1988 | (DE) . |
| 06235197 A | 8/1994 | (JP) . |
| WO 98/32921 | 7/1998 | (WO) . |

* cited by examiner

*Primary Examiner*—Teresa Walberg
*Assistant Examiner*—Fadi H. Dahbour
(74) *Attorney, Agent, or Firm*—Nixon & Vanderhye P.C.

(57) ABSTRACT

A method and device for drying a coated web. The coated web is first conveyed through a web heating unit (10, 32, 40), in which the temperature of the coated web is raised, typically to drying temperature, by directing jets of heating air at the coated web, the humidity $a_1$ of the said heating air jets being higher than the humidity $a_2$ of the drying air jets. After this the coated web is conveyed through at least one air dryer (34, 36, 38; 42, 44, 46), in which drying air jets are directed at the coated web for drying the coated web.

15 Claims, 4 Drawing Sheets

| Dryer | E(kW/m) | T air (Co) | v air (m/s) | moisture (g/kg) |
|---|---|---|---|---|
| 2 rows IR | 230 | | | |
| 1-float | | 280 | 55 | 60 |
| 2-float | | 280 | 55 | 60 |
| 3-float | | 280 | 55 | 60 |

| Dryer | E(kW/m) | T air (Co) | v air (m/s) | moisture (g/kg) |
|---|---|---|---|---|
| 1-float | | 175 | 55 | 300 |
| 2-float | | 280 | 55 | 60 |
| 3-float | | 280 | 55 | 60 |
| 4-float | | 280 | 55 | 60 |

METHOD AND DEVICE FOR DRYING A COATED WEB

The object of the present invention is a method and device specified in the independent claims presented below for drying a coated web.

Traditionally, various types of airborne web-dryers, air dryers, infrared radiators and cylinder groups have been used for drying coated paper and board. The drying of a coated web is characterised by the fact that the initial drying stage must be carried out without contact with the web, that is, traditionally by means of air drying or infrared drying because the wet coating will not withstand mechanical contact.

The method of drying a pigment coating has a significant effect on the qualities of the finished paper. Both evaporation and the absorption of water into the base paper at the initial drying stage cause rearrangement of the binders in the coating. The time lag between the application of the coating and the start of drying, and the evaporation rate during drying proper, influence the binder distribution of the coating in the direction of its thickness and also the density of the surface.

The initial drying stage can be divided into the heating stage and the drying stage proper, that is, the evaporation stage. After the evaporation stage, the absorption of water into the base paper has practically ceased and the coating has solidified to such an extent that the drying no longer affects the quality of the coating in the same way. After this stage the coating can be allowed to come into contact with the rolls and cylinders.

In order to dry a coated web, it must be subjected to a certain amount of energy during drying. By far the greatest part of the energy is obviously consumed by evaporation, but in some cases the amount of energy used for heating the web may also rise to a high level. In air dryers, the energy is transmitted to the web by convection. In an infrared dryer, the energy is transmitted to the web through electromagnetic radiation.

It has been found that if coated paper is only dried by means of conventional air dryers, that is, by blowing dry hot air towards the coated web, the coating often becomes blotchy and its surface strength properties will be poor. It has been assumed that this is due to the fact that air drying heats the coating slowly. Attempts have been made to eliminate the problem by heating the coated web by means of infrared dryers before air drying proper. The infrared dryers heat the web more evenly than conventional air dryers. The infrared dryers can also raise the temperature of the coated web to the desired, sufficiently high level, usually to a temperature of about 70° C., considerably more rapidly than air dryers.

Infrared heaters are, however, expensive devices and their operating costs are much higher than those of conventional air dryers, that is, airborne web-dryers.

It has previously also been suggested, in the American patent publication U.S. Pat. No. 5,536,535, that the coated web be dried by means of superheated steam with a wet bulb temperature of more than 85° C. By means of superheated steam, the temperature of the web can be raised rapidly to the required drying temperature, which is, however, high when drying by means of superheated steam, that is, almost 100° C. In the solution disclosed in the US publication, the web thus has to be dried at a considerably higher temperature than when drying with hot air.

It has also been found that interrupting the conventional drying of a coated web at the initial drying stage by free drawing of the web between individual air dryers may impair the quality of the paper. This is assumed to be due to the fact that the drying of the coating layer slows down during a free draw, which means that during a free draw, more water is able to pass from the coating layer to the base web than at the air dryer. The water thus transferred causes the base web to swell and causes fibre based roughness in a wood-containing base web and changes resembling such roughness in a wood-free base web. These should be eliminated.

The aim of the present invention is, therefore, to achieve an improved method and device for drying a coated web compared with those described above.

The aim is particularly to achieve a method and device by means of which the web to be dried can be heated to the required drying temperature more economically than before.

The aim is also to achieve a method and device by means of which the cooling of the web between air dryers is prevented.

In order to achieve the aims presented above, the method and device relating to the invention are characterised by what is specified in the characterising parts of the independent claims presented below.

A typical method relating to the invention concerns a drying method in which the coated web is first taken through a heating unit, in which the temperature of the coated web is raised to drying temperature or close to drying temperature, and in which the coated web thus heated is then taken through at least one air dryer, in which drying air jets are directed at the coated web in order to dry the coated web.

In this solution relating to the invention, the heating of the web in the heating unit is carried out by means of humid, hot air. The heating typically takes place in an air dryer by blowing hot air jets towards the coated web, the humidity $a_1$ of the air jets being substantially higher than the humidity $a_2$ of the air jets of the dryer section proper that follow. In this way the, temperature of the coated web can be increased safely and rapidly to the required drying temperature, typically to a temperature of approximately 60–80° C.

The high temperature of the coating reduces migration of the binder. The most important reason for this is that the coating can solidify or lock more quickly and in wetter form than when the coating is heated more slowly by means of a conventional air dryer. Rapid heating gives a more porous coating which absorbs printing inks more evenly.

The steam in the hot air jets relating to the invention condenses on the surface of the coated web, forming a thin film of water and emitting heat evenly to the coated web. This means that no areas that heat up and dry faster or more slowly will be formed in the web. As long as the temperature of the coated web is lower than the dew point of the drying air, water will condense on the surface of the web and release an amount of energy corresponding to evaporation enthalpy. In consequence of this, the solidification of the coating can be achieved rapidly by means of humid, hot blast air. For example, by means of blast air with a wet bulb temperature of 70° C., film formation of latex can be achieved rapidly. Evaporation which starts at this stage will thus no longer cause binder migration. Neither does the surface-direction structure of the coating vary to any significant degree at this stage.

Since the rate of condensation on the coated web is the faster, the cooler the area on the surface of the web, the release of energy due to evaporation, as described above, causes the surface-direction temperature differences to level out in this type of dryer, which means that the surface-direction film formation of latex is also even, and the printing properties of the surface become uniform.

The hot air jets with high humidity can, in the case of one-sided coating, only be directed towards the coated side of the web.

The heating of the web according to the invention can in practice be simply arranged to take place e.g. in the first part of an air dryer divided into successive segments, preferably in its first segment, in which substantially more humid hot air is blown towards the web than in the other segments.

The humidity of the heating air jets can preferably be maintained within the humidity range of >0.1 $kg_{water}/kg_{dry\ air}$, typically within the range of 0.2–0.5 $kg_{water}/kg_{dry\ air}$.

The humidity of the drying air jets, on the other hand, is usually below 0.2 $kg_{water}/kg_{dry\ air}$, typically about 0.1 $kg_{water}/kg_{dry\ air}$, however, lower than that of the heating air jets.

According to a preferred embodiment of the invention, the initial drying of the coated web can, therefore, be carried out by means of an air dryer comprising various segments, in the first of which the humidity is high, e.g. 0.2–0.5 $kg_{water}$/kg dry air and the temperature within the range 100–500° C., typically about 150–300° C. In such a case the web will heat up rapidly in the first part of the dryer, however, without a high evaporation rate, that is, without uneven evaporation, which results in advantageous properties as regards quality.

In order to obtain an advantageous drying result, in the solution relating to the invention, drying in the different segments of the air dryer is preferably regulated by adjusting the wet bulb temperature of the drying air. Good quality and efficient heating of the web can thus be obtained through air drying alone, without using infrared heaters.

The wet bulb temperature of the heating air jets relating to the invention is below 85° C., typically about 70–80° C. With such heating air jets the temperature of the coated web can be increased rapidly in the web heating unit to the actual drying temperature required by drying, that is, evaporation, without risk of uneven drying. In the other segments of the air dryer, the evaporation or drying segments, lower levels of air humidity are applied than at the heating stage, which means savings in the costs of heating the drying air. Evaporation already takes place at a relatively low temperature level, that is, when the temperature of the web is typically at 60–70° C. In addition the evaporation rates are higher than when a higher return air humidity is maintained. The humidity in the different segments of the air dryer can easily be adjusted so that the temperature profile of the web is optimal in the entire dryer.

The humid heating air required for the web heating unit can be obtained by humidifying the supply or replacement air with steam or water and by heating the humid air e.g. by means of a gas burner or steam radiator before blowing the jets of air towards the coated web. According to a preferred embodiment of the invention, however, the humid exhaust air from the first evaporation segments proper can also be used as replacement or supply air in the web heating unit segment. In some cases, all the air can be circulated out of the air dryer through the web heating unit.

In practice, it is advantageous to carry out air drying by means of a so-called long float, successive airborne web-dryers or airborne web-dryer segments, which are connected to each other so that the web travels from one segment to the next mainly without free draws of the web. In each airborne web-dryer there may only be small web gaps through which the web can pass from one dryer segment to the next. On the other hand, airborne web-dryers can also be integrated into one large common chamber, provided that the required air circulation is arranged in the different segments of the chamber.

A typical air dryer relating to the invention comprises 2–5 successive dryer segments. The overall length of the air dryer is thus 5–12 m.

By integrating the airborne web-dryers into a single construction, the fall in temperature of the web which takes place during free draws and the consequent disadvantages are avoided. The temperature of the coated web travelling through the successive segments of the air dryer can thus be maintained continuously by means of drying air jets at an optimal level for the process.

The invention is described in greater detail in the following, with reference to the appended drawings in which FIG. 1 shows the humidity, temperature and evaporation curves of a coated web dried in a conventional air dryer provided with infrared dryers;

The variations in temperature of the coated web as it travels through the dryer are shown by the centremost pairs of curves $T_1$ and $T_2$, that is, separately for the base web ($T_1$) and for the coating ($T_2$). In the figure it can be seen that the temperature of the coated web is approximately 30° C. when it arrives at the dryer section. In the first infrared dryer (ir) the temperature rises rapidly to over 50° C., but falls during the free draw before the second infrared dryer to a temperature below 50° C. In the second infrared dryer the temperature of the web rises to somewhat over 60° C., but falls again down to a temperature below 60° C. during the next free draw. It is not until the first evaporation unit (foil) that the temperature of the web and the coating rises to above 70° C., to fall during the next free draw (fd) to a temperature well below 70° C. The temperature of the web also rises and falls in the same manner as it travels through the next two evaporation units. The figure shows that the web does not reach the desired maximum temperature until the last section of each evaporation unit.

Due to the temperature variation, the evaporation of water from the coating also varies drastically, as is shown by the upper curve ($E_2$) of the lowest pair of curves $E_1$ and $E_2$. The variations in temperature and the slow heating of the web result in the above-mentioned disadvantageous phenomena in the drying of the coating.

The topmost pair of curves $D_1$ and $D_2$ shows the dry matter content of the base web ($D_1$) and the coating layer ($D_2$) in different parts of the dryer.

Figure 1:
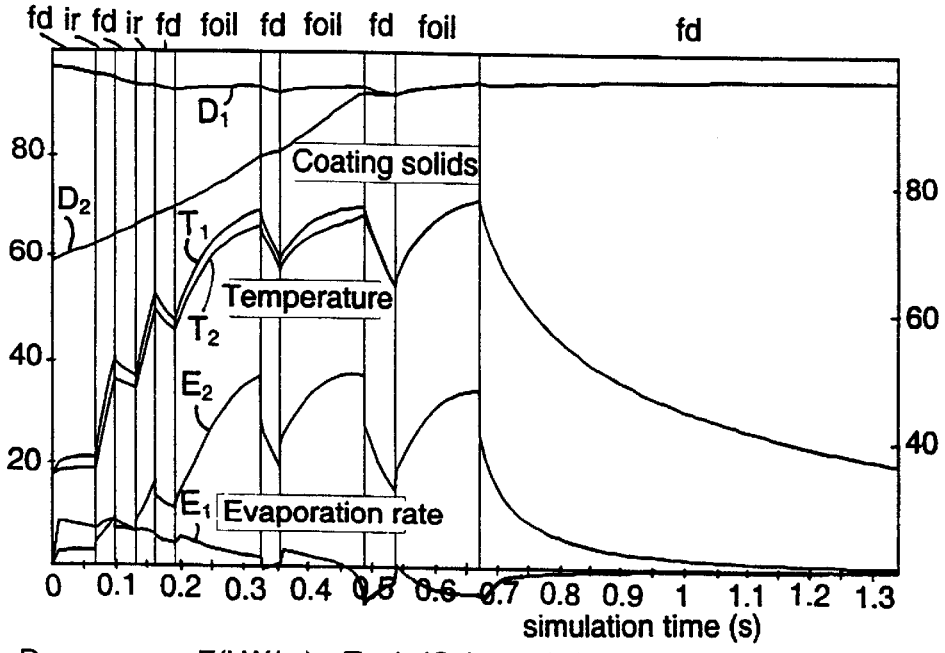
FIG. 1 shows the humidity, temperature and evaporation curves of a coated web dried in a conventional dryer section provided with infrared dryers (ir) and airborne web-dryers (foil). The web has been conveyed between the infrared dryers and airborne web-dryers by means of a free draw (fd).
Figure 2:
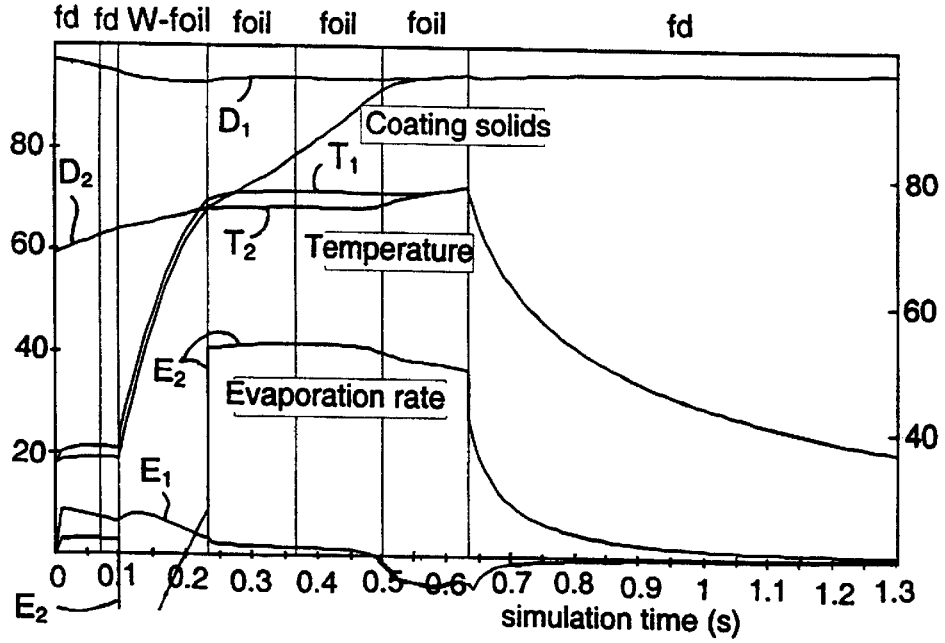
FIG. 2 shows, in the manner or FIG. 1, the humidity, temperature and evaporation curves of a coated web dried in an air dryer provided with the solution relating to the invention.

FIG. 2 shows the corresponding curves for an air dryer relating to the invention in which an air dryer (w-foil) is mounted in place of the infrared heater, in which air dryer the temperature of the coated web is raised, in accordance with the invention, by means of humid air blasts.

On studying the temperature curves $T_1$ and $T_2$, it can be seen that the temperatures of the web and the coating rise rapidly to well over 70° C., and that their temperature remains at this high level throughout the entire air dryer. In the air dryer under observation, there are no free draws of the web at which the temperature could fall. Due to the high, uniform temperature, the required uniform evaporation in the coating, that is, about 40 kg $H_2O/m^2h$ in the case presented, is rapidly reached in the dryer section proper.

Figure 3:
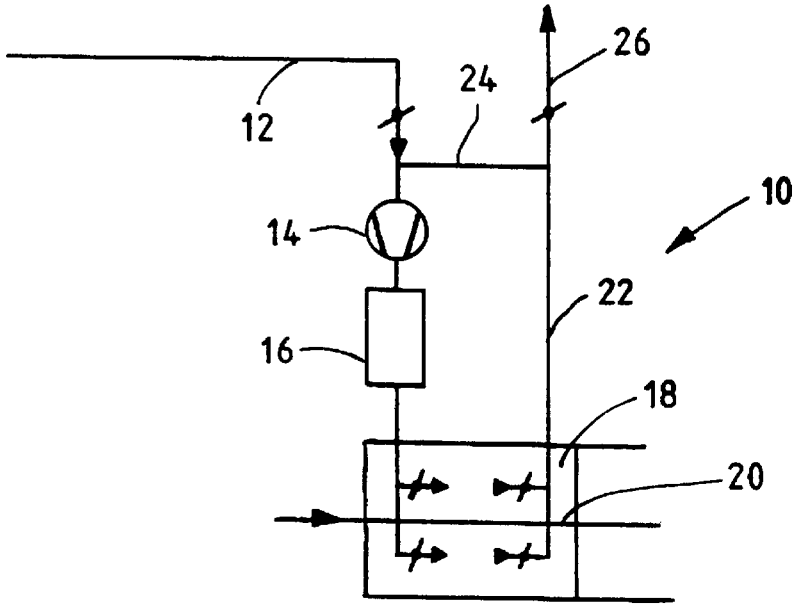
FIG. 3 shows diagrammatically a web heating unit relating to the invention.

FIG. 3 shows diagrammatically the air flow diagram of the web heating unit 10 at the start of the air dryer relating to the invention. Air of a suitable humidity, for example, exhaust air from a paper machine, is supplied by means of an aggregate 12 from any available source. The air is moved by means of a fan 14, through a heat source 16, in order to heat the humid air to a suitable temperature, after which the heated air is fed to the dryer segment 18 proper, from where the humid hot air is blown towards the web 20. The air discharged from the web is removed by means of an aggregate 22 out of the dryer segment as exhaust air. Some of the exhaust air is recirculated by means of the aggregate 24 to the fan 14, and after heating back to the dryer segment 18, and some is removed from the system by means of the aggregate 26.

Figure 4:
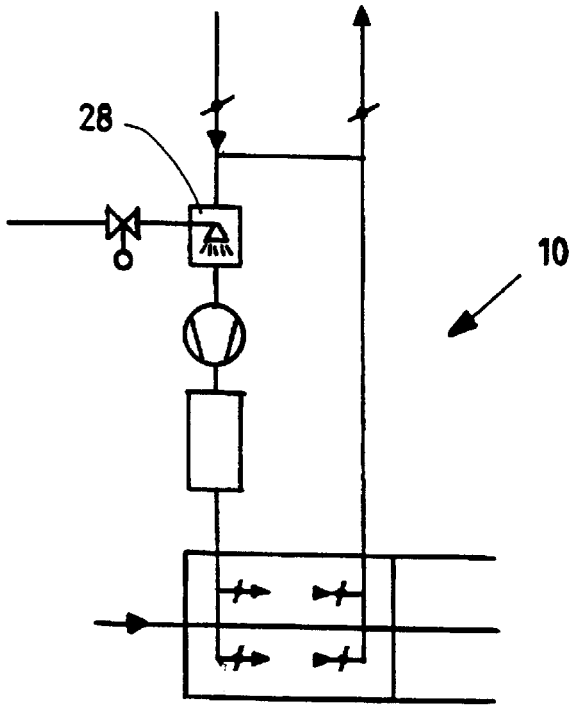
FIG. 4 shows diagrammatically a second web heating unit relating to the invention.

FIG. 4 shows the web heating unit 10 of the air dryer relating to FIG. 3, in which, however, the supply air, replacement air+return air are humidified to a suitable humidity in the humidifying unit 28 preceding the fan, by spraying steam or water into the air.

Figure 5:
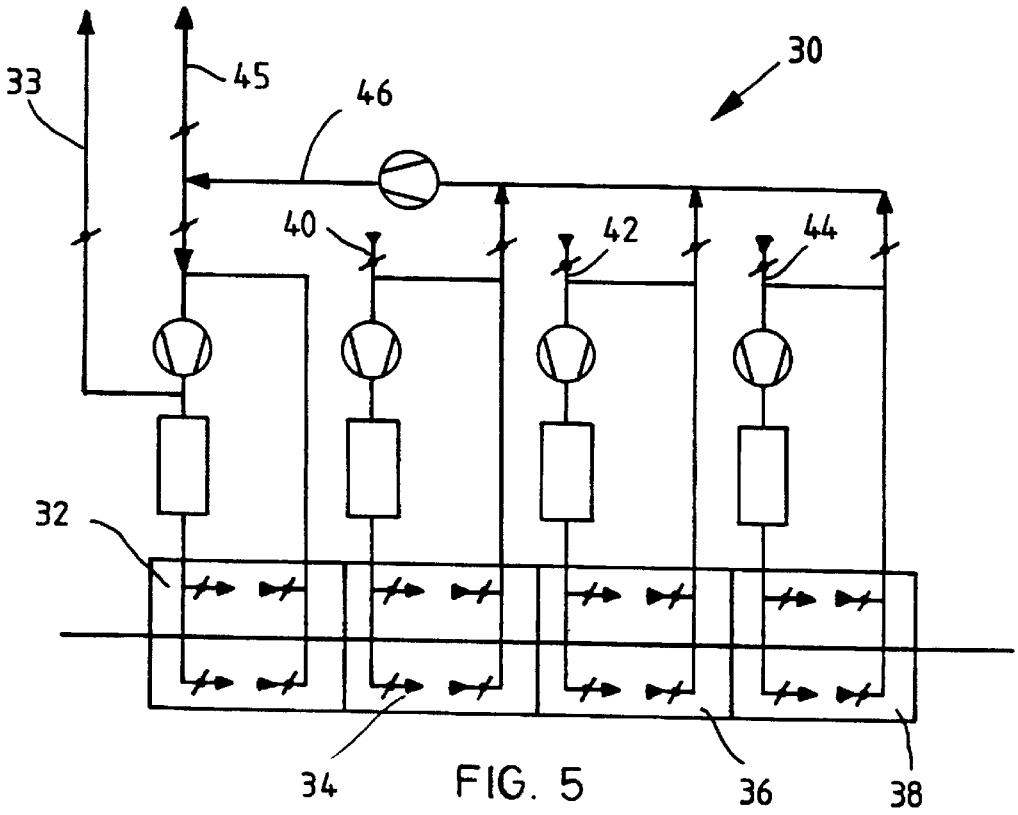
FIG. 5 shows diagrammatically an air dryer relating to the invention, in which the web heating unit is mounted in the first segment of the web heating unit divided into segments.

FIG. 5 shows an air dryer 30 relating to the invention which is divided into segments, the first segment 32 of the dryer forming the web heating unit and the second, third and fourth segments 34, 36, 38 forming evaporation units. Each segment has its own air circulation in accordance with FIGS. 3 and 4. Fresh air is supplied to the evaporation segments by means of the aggregates 40, 42, 44. The exhaust air from all the evaporation segments is brought together in the aggregate 46 to form combined exhaust air. Some of the combined humid exhaust air is supplied as replacement air to the first segment 32 of the dryer and some is removed from the dryer by the aggregate 45. Air is taken out of the dryer and the entire system by a duct 33.

Figure 6:
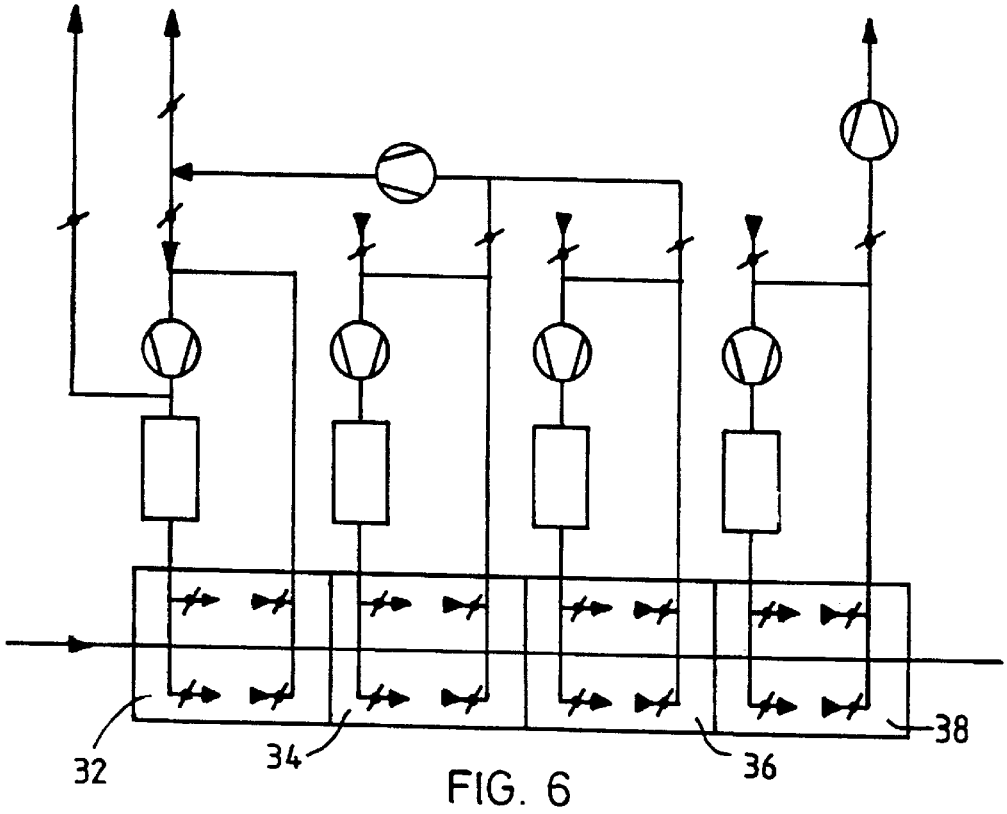
FIG. 6 shows diagrammatically, in the manner of FIG. 5, a second air dryer relating to the invention, in which the web heating unit is mounted in the first segment of the web heating unit divided into segments.

FIG. 6 shows a modified version of the dryer shown in FIG. 5, in which the humid exhaust air from only the second and third segments 34, 36 is supplied to the web heating unit 32. The already relatively dry exhaust air from the last segment 38, that is, exhaust air which is drier than the exhaust air from the segments 34 and 36, is discharged from the system.

Figure 7:
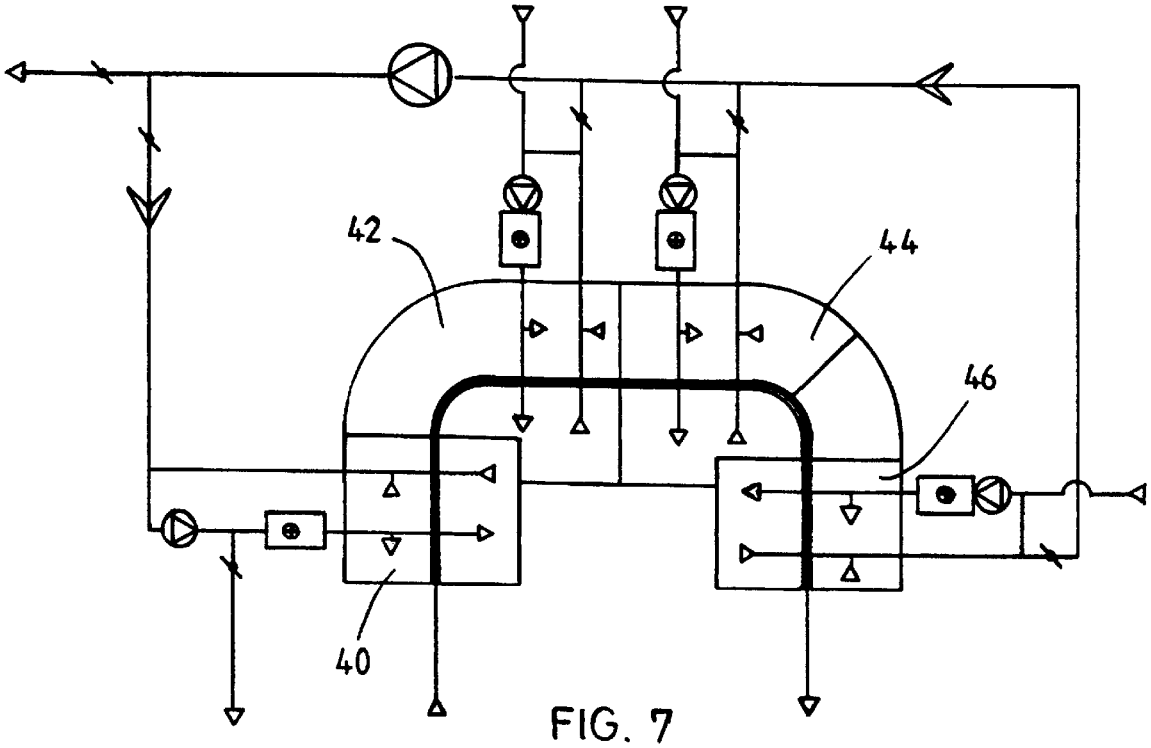
FIG. 7 shows diagrammatically an air dryer relating to the invention fitted in a curved structure, in which air dryer the web heating unit is mounted in the first segment of the air dryer unit divided into segments.

FIGS. 5 and 6 show dryers, airborne web-dryers, in which the web is conveyed mainly horizontally through the dryer. It is obviously possible to combine the separate airborne web-dryer segments into many other forms considered suitable at any particular time. FIG. 7 shows a dryer in which the coated web is first taken along an upwards directed run, then along a horizontal run and finally along a downwards directed run. It is thus possible to mount in the dryer floats, which turn the course of the web.

FIG. 7 shows a dryer formed in a curved, space-saving shape. The heating unit 40 of the dryer and the different segments 42, 44 and 46 of the dryer section proper are mounted in a common curved tunnel structure. In the dryer, exhaust air is supplied to the web heating unit 40 from all the evaporation segments 42, 44, 46 following it.

Figure 8:
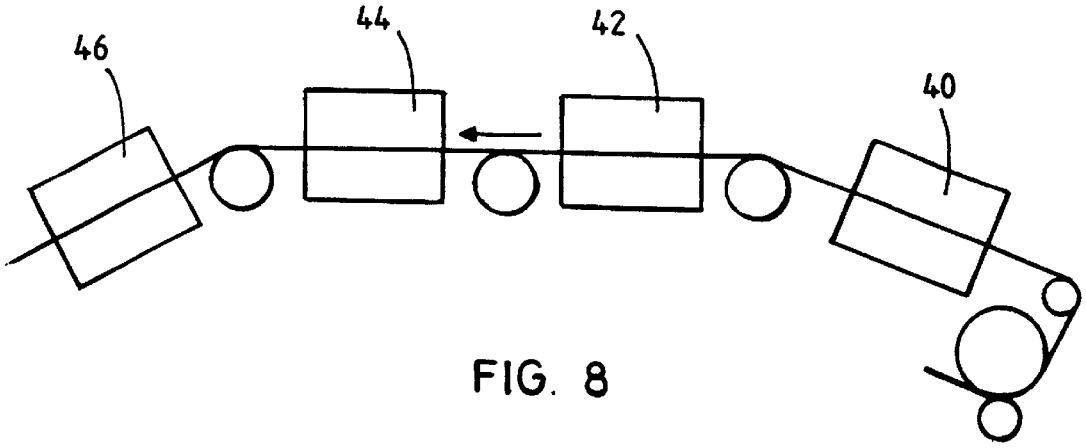
FIG. 8 shows diagrammatically a dryer section which consists of separate dryers and the web leading rolls between them.

FIG. 8 shows diagrammatically a dryer section in which the web heating unit 40 and the air dryers 42, 44 and 46 are separate. For reasons of runnability it is sometimes advantageous to implement the dryer section in this manner.

The aim is not to limit the invention to the embodiments presented above, but on the contrary to apply it extensively within the scope of protection defined in the claims below.

What is claimed is:

1. A method for drying a coated web, in which method the coated web is conveyed through a web heating unit in which the temperature of the coated web is raised to the desired temperature, typically to the drying temperature, after which the coated web heated in the web heating unit is taken through at least one air dryer, in which drying air jets are directed at the coated web in order to dry the coated web, characterised in that the temperature of the coated web is raised in the web heating unit (10) by directing heating air jets at the coated web, the humidity $a_1$ of the said heating air jets being higher than the humidity $a_2$ of the drying air jets and that and that the coated web is conveyed directly, without free drawing of the web, from the web heating unit to the air dryer.

2. A method as claimed in claim 1, characterised in that the humidity of the heating air jets is >0.1 $kg_{water}/kg_{dry\ air}$, preferably within the range of 0.2–0.5 $kg_{water}/kg_{dry\ air}$.

3. A method as claimed in claim 1, characterised in that the humidity of the drying air jets is <0.2 $kg_{water}/kg_{dry\ air}$, preferably about 0.1 $kg_{water}/kg_{dry\ air}$.

4. A method as claimed in claim 1, characterised in that the wet bulb temperature of the heating air jets is below 85° C., typically within the range of 70–80° C.

5. A method as claimed in claim 1, characterised in that the temperature of the heating air jets is 100–500° C., typically within the range of 150–300° C.

6. A method as claimed in claim 1, characterised in that the coated web is conveyed directly, without free drawing of the web, from the web heating unit to the air dryer, and that the coated web is conveyed directly, without free drawing of the web, from a first dryer segment of the air dryer to the next dryer segment in it.

7. A method as claimed in claim 1, characterised in that humid exhaust air from one or more dryer segments of the air dryer is fed into a heating air circulation of the web heating unit.

8. A method as claimed in claim 1, characterised in that the heating air of the heating unit is humidified, preferably by spraying steam or water into it.

9. A device for drying a coated web, the said device comprising a web heating unit in which the temperature of the coated web is raised to the desired temperature, typically to the drying temperature, and at least one air dryer, mounted after the web heating unit seen in the running direction of the web, the said air dryer being provided with means for directing drying air jets towards the coated web travelling through the air dryer, characterised in that the web heating unit (10, 32, 40) comprises means for directing humid heating air jets at the coated web (20) travelling through the web heating unit, the humidity $a_1$ of the said heating air jets being higher than the humidity $a_2$ of the drying air jets, and that the coated web is arranged so as to be conveyed directly, without free drawing of the web, from the web heating unit to the air dryer.

10. A device as claimed in claim 9, characterised in that the air dryer (30) comprises at least two, preferably several, segments (32, 34, 36, 38; 40, 42, 44, 46), which are connected to each other in succession so that the web runs from one segment to the other mainly without free draws, and that the first segment (32, 40) of the air dryer forms a heating unit and the following segments (34, 36, 38; 42, 44, 46) of the air dryer form the dryer section proper of the air dryer.

11. A device as claimed in claim 9, characterised in that the air dryer comprises 2–5 different segments which are mounted under a common hood, and that the length of the air dryer is >5 m, typically 5–12 m.

12. A device as claimed in claim 9, characterised in that the air dryer comprises successive airborne web-dryers which are provided with air circulation, and that in a first segment of the dryer, humid exhaust air from one or more of the following segments, or from a paper machine, is supplied as replacement air to the web heating unit.

13. A device as claimed in claim 9, characterised in that the web heating unit comprises means (16) for heating the heating air by means of a gas burner, steam radiator, or other suitable manner to a temperature of about 100–500° C., typically 150–300° C., before the air is blown in jets towards the coated paper web.

14. A device as claimed in claim 9, characterised in that the web heating unit comprises means (16) for humidifying the heating air by spraying steam or water into it, so that the wet bulb temperature of the heating air jets is below 85° C., typically within the range of 70–80° C., before the air is blown in jets towards the coated paper web.

15. A device as claimed in claim 9, characterised in that the air dryer is comprised of successive segments which are mounted in the shape of a semi-circle or the like, so that when the web travels through them, it will first travel upwards, then in the horizontal direction, and finally downwards.

* * * * *

UNITED STATES PATENT AND TRADEMARK OFFICE

CERTIFICATE OF CORRECTION

PATENT NO. : 6,311,410 B1
DATED : November 6, 2001
INVENTOR(S) : Heikkilä et al.

It is certified that error appears in the above-identified patent and that said Letters Patent is hereby corrected as shown below:

Column 6,
Line 16, delete the word "typically to the" and insert -- being a --;
Line 23, delete the word "the" and insert -- a --;
Line 27, change "and that and that" to -- and that --;
Line 32, delete ", preferably within the range of 0.2-0.5 $kg_{water}/kg_{dry\ air}$";
Line 35, delete ', preferably about 0.1 $kg_{water}/kg_{dry\ air}$";
Line 38, delete ", typically within the range of 70-80º C.";
Line 41, delete ", typically within the range of 150-300º C.";
Line 55, delete "preferably",
Line 59, change "the" to -- a --;
Line 60, change "to" to -- being --;
Line 60, change "typically to the" to -- being a --

Column 7,
Lines 10-11, delete "preferably several"
Line 22, delete "typically 5-12 m";

Column 8,
Lines 7-8, delete "or other suitable manner";
Line 9, delete "typically 150-300º C.";
Line 16, delete "typically within the range of 70-80º C.;
Line 20, delete "or the like".

Signed and Sealed this

Second Day of July, 2002

*Attest:*

*Attesting Officer*

JAMES E. ROGAN
*Director of the United States Patent and Trademark Office*